US005490618A

United States Patent [19]

Davidson

[11] Patent Number: 5,490,618

[45] Date of Patent: Feb. 13, 1996

[54] PAINT PAIL CARRIER

[76] Inventor: Dennis A. Davidson, 81 Bailey Ave., Patchogue, N.Y. 11772

[21] Appl. No.: 393,354

[22] Filed: Feb. 23, 1995

[51] Int. Cl.[6] ..... A45F 5/00

[52] U.S. Cl. ..... 224/148; 224/208; 224/222

[58] Field of Search ..... 224/148, 191, 224/197, 202, 208, 224, 240, 222, 904, 907, 225, 253, 268

[56] References Cited

U.S. PATENT DOCUMENTS

| | | | |
|---|---|---|---|
| 1,109,161 | 9/1914 | Chindgren | 224/225 |
| 1,292,728 | 1/1919 | Dozier | 224/253 |
| 1,494,183 | 5/1924 | Ohman | 224/907 |
| 1,723,147 | 8/1929 | Fourethier | 224/197 |
| 3,212,690 | 10/1965 | Green | 224/224 |
| 3,493,152 | 2/1970 | Ort | 224/907 |
| 4,325,503 | 4/1982 | Swinney | 224/268 |
| 5,016,791 | 5/1991 | Burow | 224/148 |
| 5,067,643 | 11/1991 | McKinney | 224/197 |
| 5,163,591 | 11/1992 | Leiserson | 224/907 |

*Primary Examiner*—Henry J. Recla
*Assistant Examiner*—Gregory M. Vidovich

[57] ABSTRACT

A paint pail carrier for attachment to a person for maintaining an open paint pail in a vertical orientation is disclosed. The invention has a paint pail cradle having a vertically oriented elongated member having a lower section with a horizontally disposed base for supporting the paint pail. The cradle has an upper section adapted for swivel communication with a gimbal, and a middle section therebetween having an arcuate ring for keeping the open paint pail in a fixed position on the base. A shoulder strap is used for firmly fitting over either shoulder of the person for supporting the weight of the open paint pail. A leg strap is used for firm attachment to the person's leg, and has an elongated member downwardly disposed for slidable communication with the elongated member of the paint pail cradle. A waist strap is disposed the shoulder strap and the leg strap for firm attachment to the person's waist. The waist strap further has an aperture adapted to receive the gimbal for urging swivel movement of the paint pail cradle and maintains the paint pail in a vertical orientation as the person climbs up or down a ladder.

8 Claims, 4 Drawing Sheets

FIG 7
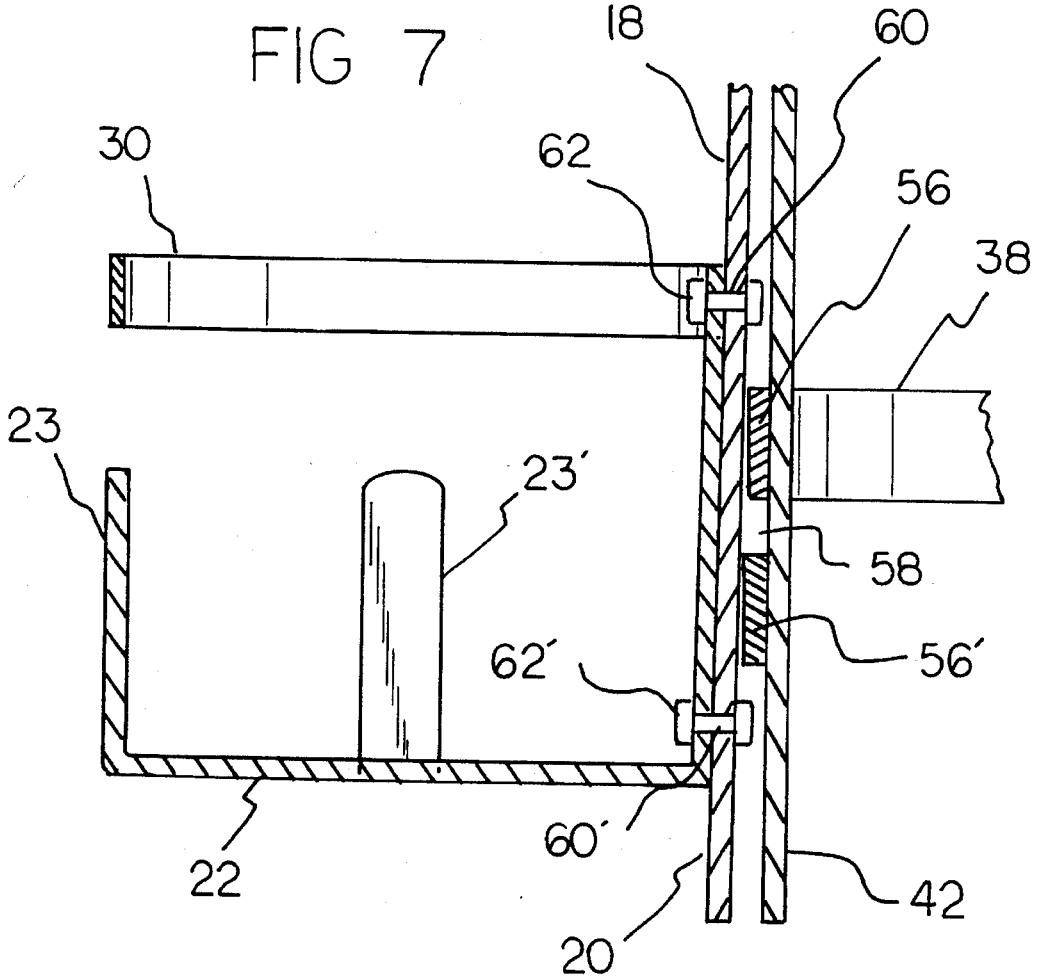
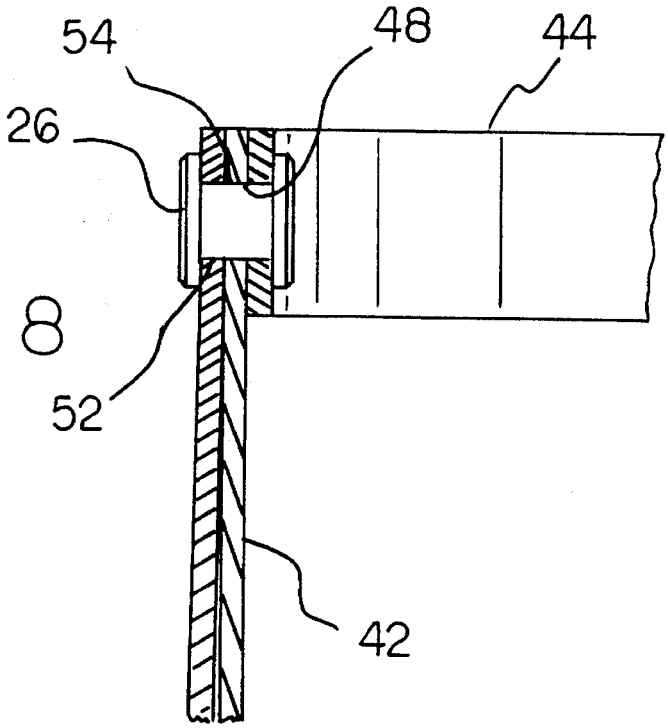
FIG 8

PAINT PAIL CARRIER

BACKGROUND OF THE INVENTION

1. Field of the Invention

The present invention relates to a new and improved paint pail carrier and, more particularly, pertains to an apparatus for maintaining an open paint pail in a vertical orientation when climbing up and down a ladder.

2. Description of the Prior Art

The use of paint pail holsters suspended from a belt is known in the prior art. More specifically, a paint pail holster suspended from a belt heretofore devised and utilized for the purpose of holding an open paint pail for allowing both hands of the painter freedom to work are known to consist basically of familiar, expected, and obvious structural configurations, notwithstanding the myriad of designs encompassed by the crowded prior art which has been developed for the fulfillment of countless objectives and requirements.

The prior art discloses a large number of paint pail holsters suspended from a belt. By way of example, U.S. Pat. No. 5,016,791 issued to Burow discloses a painter's pail carrier having reliable securement for the paint pail whereby safety is insured together with damping of and limiting of the displacement of the paint pail from its optimum vertical condition. U.S. Pat. No. '791 is silent on the use of strapping to insure the stability of the pail when climbing up or down the ladder.

U.S. Pat. No. 5,163,591 issued to Leisurson et al. discloses a paint bucket holster for suspending a paint container from the holster which is attached to a belt around the waist of the painter. U.S. Pat. No. '591 is silent on the use of a shoulder strap to maintain the proper vertical orientation of the paint pail regardless of the position of the painter on the ladder.

U.S. Pat. No. Des. 338,561 issued to Leisurson et al. appears to disclose a paint bucket holster of a nature similar to the above mentioned utility patent. U.S. Pat. No. '561 has all of the above limitations as outlined above.

U.S. Pat. No. 5,067,643 issued to McKinney discloses a belt having a plurality of large bags in a spaced apart relationship that rests adjacent to the hips of the wearer. U.S. Pat. No. '643 also discloses a shoulder harness for supporting some of the weights of the spaced apart bags and their contents.

Lastly, U.S. Pat. No. 5,004,136 issued to Leath discloses a utility belt for encircling a person's waist and having a plurality of webbed elements in a spaced apart relationship for carrying spray bottles, gloves, dusters and cleaning towels typically found in a maintenance environment setting. U.S. Pat. No. '136 is silent on the use of shoulder straps to maintain the objects in an optimum vertical desired orientation when climbing up and down a ladder.

In this respect, the paint pail carrier according to the present invention substantially departs from the conventional concepts and designs of the prior art, and in doing so provides an apparatus primarily developed for the purpose of maintaining an open paint pail in a vertical orientation when climbing up and down a ladder.

It is therefore an object of the present invention to provide a new and improved paint pail carrier which has all the advantages of the prior art paint pail holsters and none of the disadvantages.

It is another object of the present invention to provide a new and improved paint pail carrier which may be easily and efficiently manufactured and marketed.

It is a further object of the present invention to provide a new and improved paint pail carrier which is of a durable and reliable construction.

An even further object of the present invention is to provide a new and improved paint pail carrier which is susceptible of a low cost of manufacture with regard to both materials and labor, and which accordingly is then susceptible of low prices of sale to the consuming public, thereby making such a paint pail carrier economically available to the buying public.

Still yet another object of the present invention is to provide a new and improved paint pail carrier which provides in the apparatuses and methods of the prior art some of the advantages thereof, while simultaneously overcoming some of the disadvantages normally associated therewith.

Even still another object of the present invention is to maintain an open paint pail in a vertical orientation when climbing up and down a ladder.

Lastly, it is an object of the present invention to provide a paint pail carrier for attachment to a person for maintaining an open paint pail in a vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, it can be appreciated that there exists a continuing need for a new and improved paint pail carrier which can be used for maintaining an open paint pail in a vertical orientation when climbing up and down a ladder. In this regard, the present invention substantially fulfills this need.

SUMMARY OF THE INVENTION

In view of the foregoing disadvantages inherent in the known types of paint pail holsters suspended from a belt now present in the prior art, the present invention provides a new and improved paint pail carrier. As such, the general purpose of the present invention, which will be described subsequently in greater detail, is to provide a new and improved paint pail carrier and methods which have all the advantages of the prior art and none of the disadvantages.

To attain this, the present invention essentially comprises a paint pail carrier for attachment to a person for maintaining an open paint pail in a vertical orientation. The invention has a paint pail cradle having a vertically oriented elongated member having a lower section with a horizontally disposed base for supporting a paint pail, an upper section adapted for swivel communication with a gimbal means, and a middle section therebetween having an arcuate ring for keeping the open paint pail in a fixed position on the base. A shoulder strap is employed for firmly fitting over either shoulder of the person for supporting the weight of the open paint pail. A leg strap is used for firm attachment to the person's leg, the leg strap further having an elongated member downwardly disposed for slidable communication with the elongated member of the paint pail cradle.

A waist strap is disposed between the shoulder strap and the leg strap for firm attachment to the person's waist, the waist strap further having an aperture adapted to receive the gimbal for urging swivel movement of the paint pail cradle for maintaining the paint pail in a vertical orientation as the person climbs up or down a ladder. A plurality of slide strips are oriented on an outer surface of the elongated member of the leg strap for urging slidable contact between the downwardly disposed elongated member of the leg strap and the downwardly disposed elongated member of the paint pail cradle.

The paint pail cradle further has a plurality of apertures adapted to receive rivet fasteners for urging fixed communication between the arcuate ring and the base which has a plurality of intersecting elongated metallic units and a plurality of upstanding elongated fingers extending therefrom the base.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a vertical elevation plan cross-section taken along viewing lines 7—7 in FIG. 6. FIG. 7 discloses the ring portion of the paint pail holder and the slide strips.

FIG. 8 is a vertical elevation sectional view of the invention taken along viewing lines 8—8 in FIG. 4. FIG. 8 discloses the gimbal means for allowing free movement of the bucket arm.

The same reference numerals refer to the same parts throughout the various Figures.

DESCRIPTION OF THE PREFERRED EMBODIMENT

Figure 1:
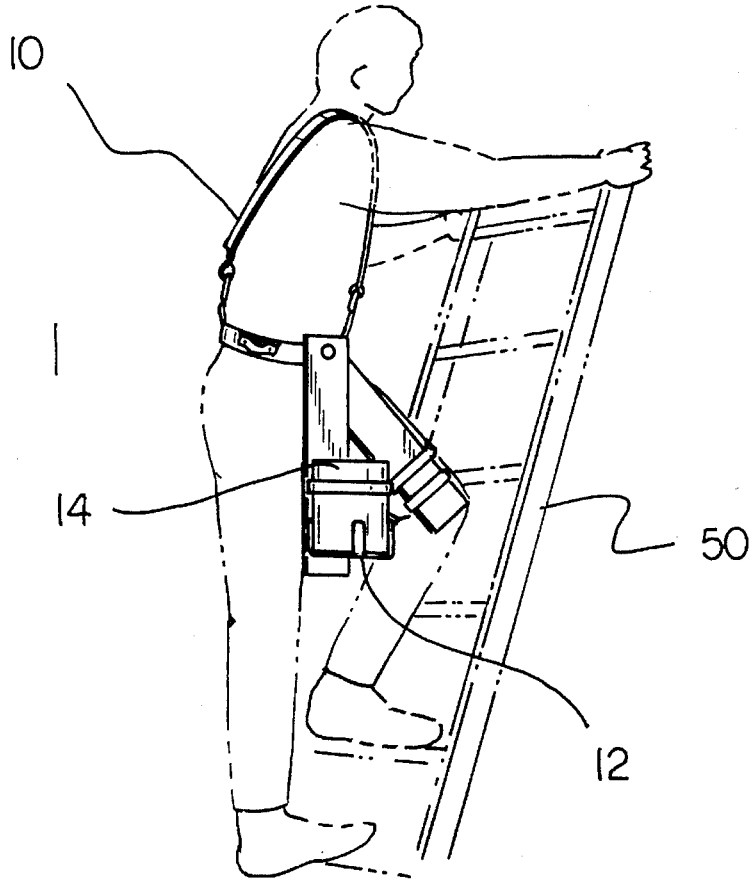
FIG. 1 is a perspective illustration of the preferred embodiment of the paint pail carrier constructed in accordance with the principles of the present invention and discloses the invention worn by a painter while climbing a ladder.
Figure 2:
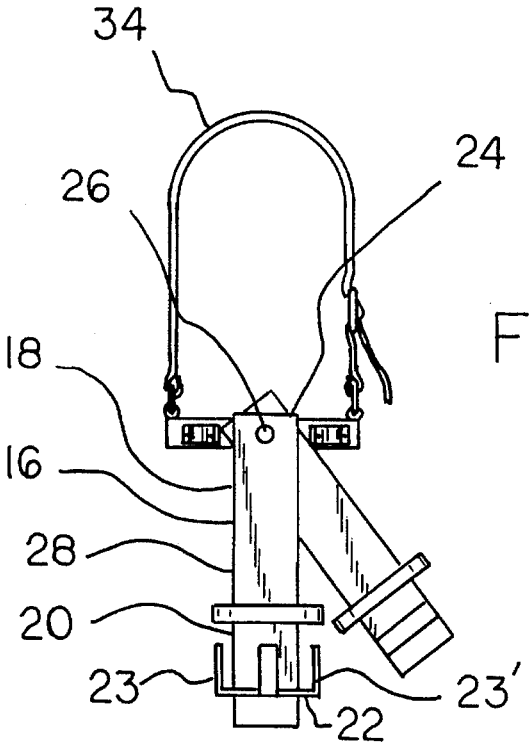
FIG. 2 is a front elevation view of the invention in the uninstalled status disclosing the shoulder strap, the leg attachment and the cradle for holding the paint pail.
Figure 3:
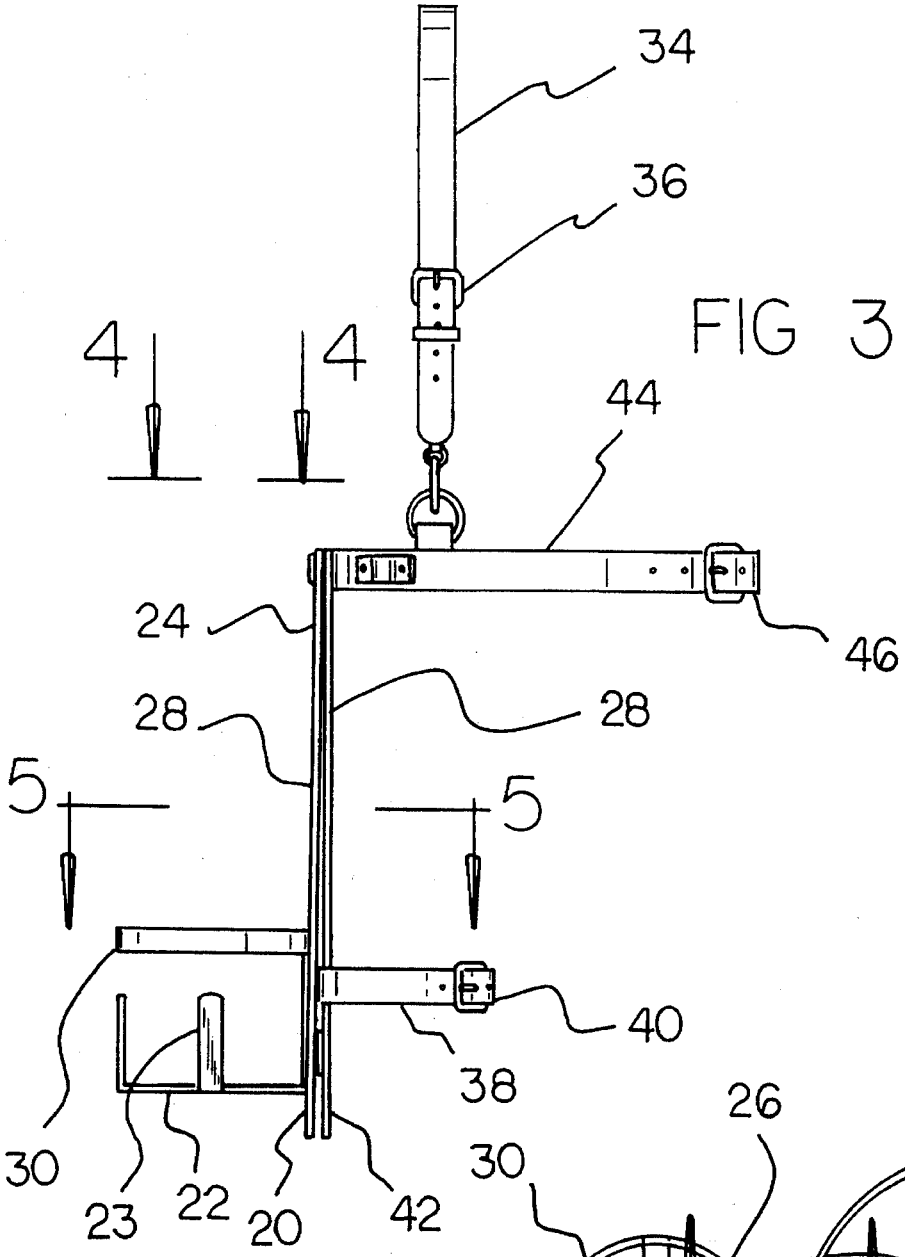
FIG. 3 is a right-hand elevation view of the invention disclosing the waist strap in a central portion thereof, the leg strap in a lower right-hand section thereof, and the paint pail holder in a leftmost section thereof.
Figure 4:
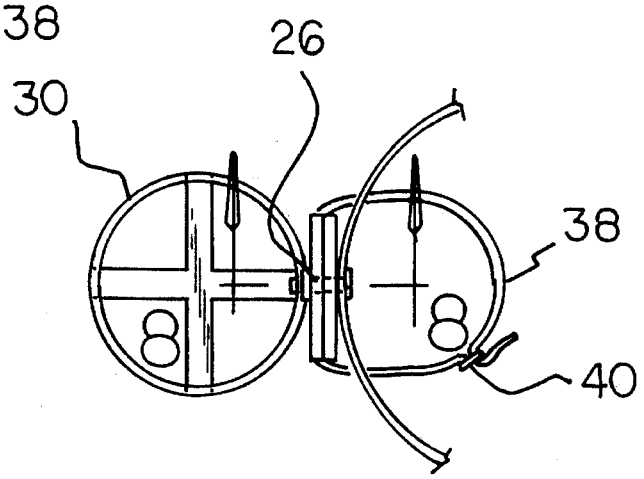
FIG. 4 is a top plan view of the invention disclosing the leg strap in the rightmost section, the paint pail cradle in the leftmost section, and a waist strap above the leg strap.
Figure 5:
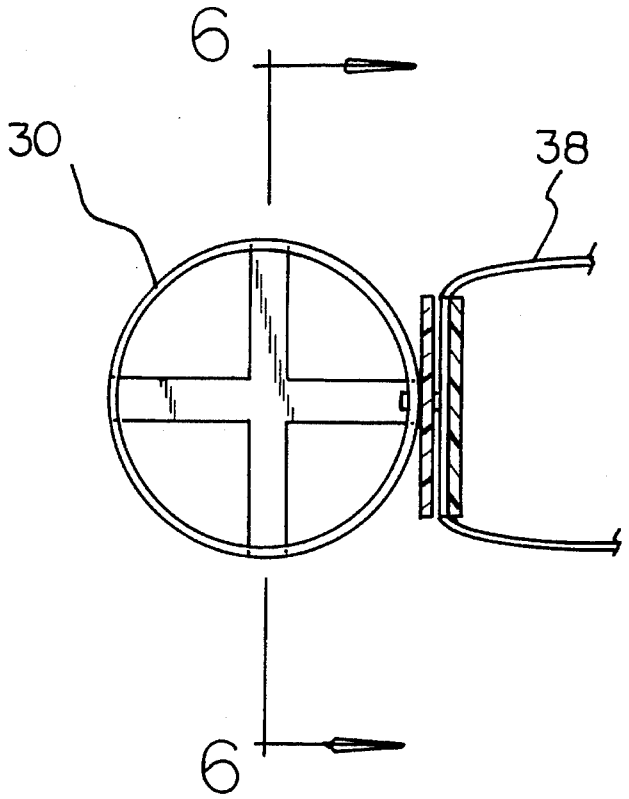
FIG. 5 is a horizontal plan sectional view of the invention taken along viewing lines 5—5 in FIG. 3.
Figure 6:
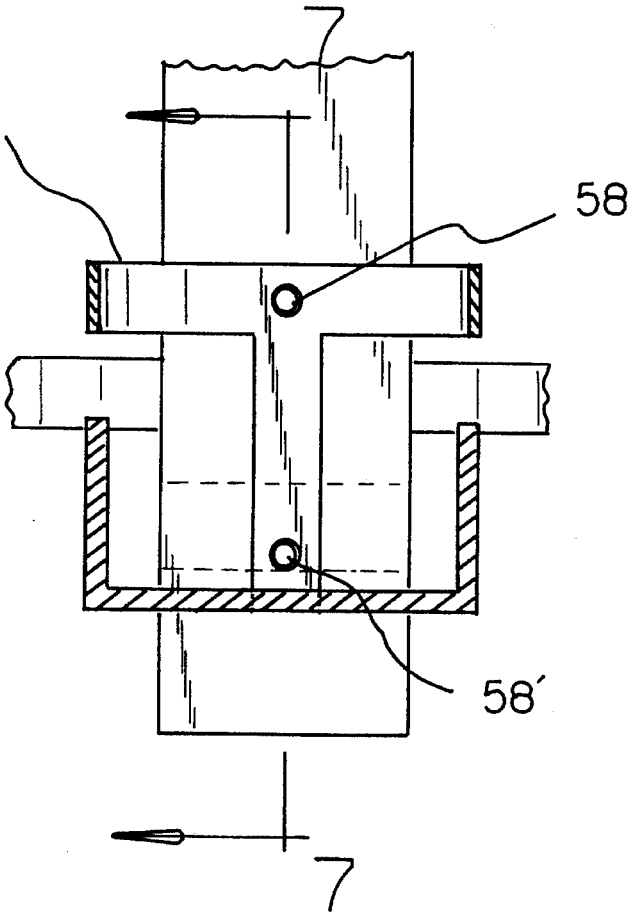
FIG. 6 is a vertical elevation section taken along viewing lines 6—6 in FIG. 5.

With reference now to the drawings, and in particular to FIGS. 1 through 9 thereof, the preferred embodiment of the new and improved paint pail carrier embodying the principles and concepts of the present invention and generally designated by the reference numeral 10 will be described.

The present invention, the new and improved paint pail carrier, is a system comprised of a plurality of components. The components in their broadest context include a cradle, a shoulder strap, a leg strap, and a waist strap. Each of the individual components is specifically configured and correlated one with respect to the other to attain the desired objectives.

The purpose of the painter's helper is to free up the hands of the painter as he or she climbs up and down ladders. Heretofore, the painter had to climb up and down a ladder using only one hand on the rungs to maintain a safe traverse because the other hand was occupied holding the can of paint. This invention will increase the safety of painters in their daily work because they will be able to traverse a ladder using both hands to maintain stability on the rungs of the ladder. Also, since the paint can remains vertical at all times, the amount of spilled paint will be dramatically reduced. It is possible to shift the can from one side to the other in the case of a left handed painter or it can be shifted to the other side to allow the painter to use the opposite hand for painting over long periods of time in order to reduce fatigue.

Referring generally to FIG. 1, the invention 10 comprises a new and improved paint pail carrier 12 for attachment to a person for maintaining an open paint pail 14 in a vertical orientation.

The carrier 12 comprises a paint pail cradle 16 having a vertically oriented elongated member 18 and a lower section 20 with a horizontally disposed base 22 and a plurality of elongated rods 23, 23' upwardly disposed from the base 22 for keeping the open paint pail 14 in a fixed position on the base 22 and for supporting the paint pail 14. An upper section 24 is adapted for swivel communication with a gimbal means 26, and a middle section 28 therebetween has an arcuate ring 30 that surrounds the paint pail 14. The cradle 16 is designed to accommodate a one gallon can, but it can also be sized to hold a one pound coffee can which is used commonly in the paint trade, but preferably a one gallon paint can size. The arcuate ring 30 surrounds the can in the cradle 16. The arcuate ring 30 can be made from any suitable material, preferably metal.

The invention 10 has a shoulder strap 34 with adjustment clasping means 36 for firmly fitting over either shoulder of the person and for supporting the weight of the open paint pail 14. A leg strap 38 having second clasping means 40 is provided for firm attachment to the person's leg. The leg strap 38 further has a second elongated member 42 downwardly disposed and in slidable communication with the elongated member 18 of the paint pail cradle 16.

A waist strap 44 is disposed therebetween the shoulder strap 34 and the leg strap 38 and has third clasping means 46 for firm attachment to the person's waist. The waist strap 44 further has an aperture 48 adapted to receive the gimbal means 26 and urges swivel movement of the paint pail cradle 16 and further maintains the paint pail 14 in a vertical orientation when the person climbs up or down the ladder. The elongated member 18 of the paint pail cradle 16 and the second elongated member 42 of the leg strap 38 are adapted with a second and third aperture 52, 54, respectively to receive the gimbal means 26. A plurality of slide strips 56, 56' are oriented on an outer surface 58 of the second elongated member 42 of the leg strap 38 and urge slidable contact between the second elongated member 42 of the leg strap 38 and the first elongated member 18 of the paint pail cradle 16 when the painter is climbing up and down the ladder. The paint pail cradle 16 further has a plurality of apertures 60, 60' adapted to receive rivet fasteners 62, 62' and urges fixed communication between the arcuate ring 30 and the upwardly disposed rods 23, 23' and the base 22.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A paint pail carrier adapted for attachment to a person for maintaining an open paint pail in a vertical orientation, said carrier comprising:

a waist strap having clasping means thereon for firm attachment to the waist of the person;

a shoulder strap having opposing ends attachable to the waist strap and adjustment clasping means for firmly fitting over a shoulder of the person;

a vertically oriented first elongate member having a lower section, an upper section and a middle section therebetween wherein said lower section has means thereon for supporting the paint pail and said upper section having means thereon for swivel attachment to a location on said waist belt; and a second elongate member having means thereon for swivel attachment to said location on said waist belt and a leg strap having clasping means thereon for firm attachment to a leg of the person adjacent said location on said waist belt, said second elongate member having at least one slide strip oriented on an outer surface thereof adapted for sliding engagement with a surface of said vertically oriented first elongate member.

2. A paint pail carrier as recited in claim 1 wherein the means for supporting the paint pail comprises a horizontally disposed base and a plurality of elongated rods upwardly disposed from the base.

3. A paint pail carrier as recited in claim 1 wherein the means for swivel attachment of said first elongate member comprises a gimbal means.

4. A paint pail carrier as recited in claim 1 wherein the middle section includes an arcuate ring for further supporting the paint pail.

5. A paint pail carrier as recited in claim 3 wherein the waist strap further includes an aperture at said location adapted for receiving the gimbal means for urging swivel movement of the first swivel member for maintaining the open paint pail in a vertical orientation.

6. A paint pail carrier as recited in claim 3 wherein said first and second elongate members having first and second apertures, respectively, and said waist belt having an aperture at said location, each of said first aperture, said second aperture and said aperture of said waist belt adapted to receive said gimbal means.

7. A paint pail carrier as recited in claim 1 wherein the means for supporting the paint pail comprises a horizontally disposed base and a plurality of elongated rods upwardly disposed from the base and the middle section includes an arcuate ring for further supporting the paint pail, said ring and one of said rods each having an aperture therein for receiving a rivet fastener for urging fixed communication between said arcuate ring and said one rod.

8. A paint pail carrier for attachment to a person for maintaining an open paint pail in a vertical orientation comprising, in combination:

a paint pail cradle having a vertically oriented elongated member and having a lower section with a horizontally disposed base for supporting the paint pail, an upper section adapted for swivel communication with a gimbal means, and a middle section therebetween having an arcuate ring and a plurality of elongated rods upwardly disposed from the base for keeping the open paint pail in a fixed position on the base;

a shoulder strap having adjustment clasping means for firmly fitting over either shoulder of the person for supporting the weight of the open paint pail;

a leg strap having second clasping means for firm attachment to the person's leg, the leg strap further having a second elongated member downwardly disposed for slidable communication with the elongated member of the paint pail cradle;

a waist strap therebetween the shoulder strap and the leg strap having third clasping means for firm attachment to the person's waist, the waist strap further having an aperture adapted to receive the gimbal for urging swivel movement of the paint pail cradle for maintaining the paint pail in a vertical orientation when the person climbs up or down a ladder, and further wherein the elongated member of the paint pail cradle and the elongated member of the leg strap are adapted with a second and a third aperture to receive the gimbal means;

a plurality of slide strips oriented on an outer surface of the second elongated member of the leg strap for urging slidable contact between the,second elongated member of the leg strap and the first elongated member of the paint pail cradle when the painter is climbing up and down the ladder; and the paint pail cradle further having a fourth plurality of apertures adapted to receive rivet fasteners for urging fixed communication between the arcuate ring and the upwardly disposed rods and the base.

* * * * *